United States Patent [19]

Lang

[11] 4,218,873

[45] Aug. 26, 1980

[54] SEALED, SHAPED WATCH-CASE

[75] Inventor: Jean-Louis Lang, Porrentruy, Switzerland

[73] Assignee: Louis Lang S.A., Porrentruy, Switzerland

[21] Appl. No.: 966,130

[22] Filed: Dec. 4, 1978

[30] Foreign Application Priority Data

Dec. 15, 1977 [CH] Switzerland ..... 15480/77

[51] Int. Cl.[2] ..... G04B 37/00

[52] U.S. Cl. ..... 368/281; 368/276; 368/286

[58] Field of Search ..... 58/88 R, 88 W, 89, 91, 58/94, 23 BA, 53, 56, 59, 90 R, 90 B; 248/114, 222.3

[56] References Cited

U.S. PATENT DOCUMENTS

| | | | |
|---|---|---|---|
| 3,520,130 | 7/1970 | Oltramare | 58/94 |
| 3,633,356 | 1/1972 | Kitazima et al. | 58/94 |

FOREIGN PATENT DOCUMENTS

| | | | |
|---|---|---|---|
| 2645158 | 4/1977 | Fed. Rep. of Germany | 58/88 R |
| 2758194 | 7/1978 | Fed. Rep. of Germany | 58/88 R |
| 2805453 | 8/1978 | Fed. Rep. of Germany | 58/88 R |
| 2267013 | 10/1975 | France | 58/88 R |
| 331282 | 7/1958 | Switzerland | 58/90 R |

*Primary Examiner*—J. V. Truhe
*Assistant Examiner*—John B. Conklin
*Attorney, Agent, or Firm*—Robert E. Burns; Emmanuel J. Lobato; Bruce L. Adams

[57] ABSTRACT

A sealed, shaped watch-case has a rim formed with a rectangular interior defined by a wall in which a annular groove is formed around the rim interior. The watch movement is supported in the rim by an elastically compressible retaining ring held in compression axially of the case by a circular, annular retaining part formed with radially outwardly extending projections. These projections are insertable into the rim by disposing them at corners of its rectangular interior until they are level with the groove so that rotation of the retaining part locates them in the groove to lock the retaining part in position. The case also has a base welded to an annular frame which is an interference push fit on the retaining part.

6 Claims, 2 Drawing Figures

FIG. 1
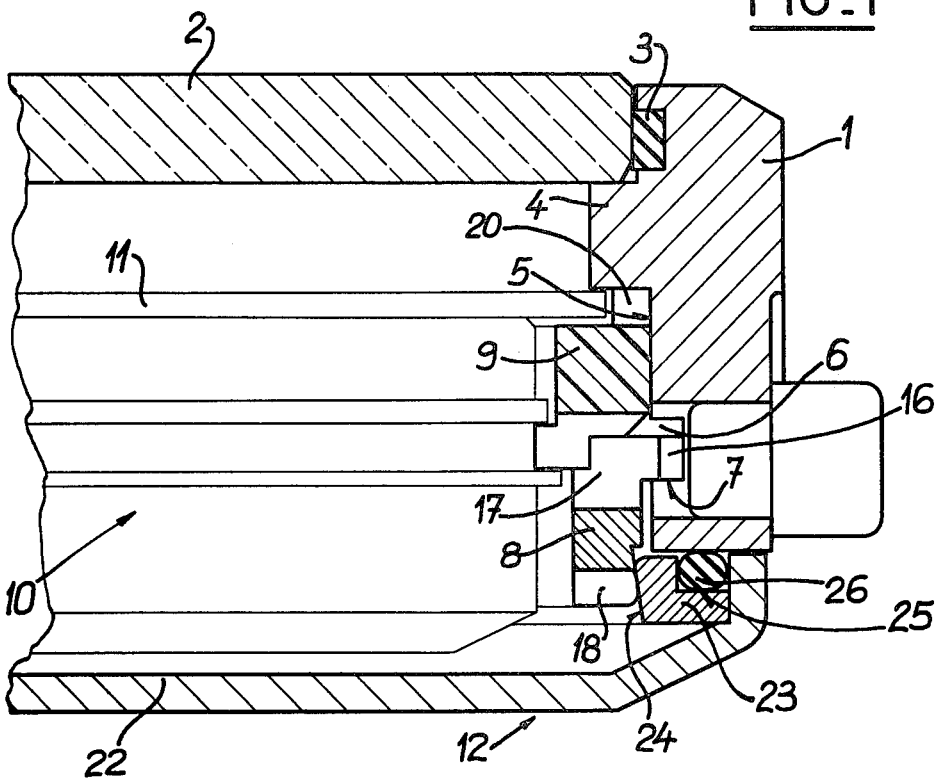
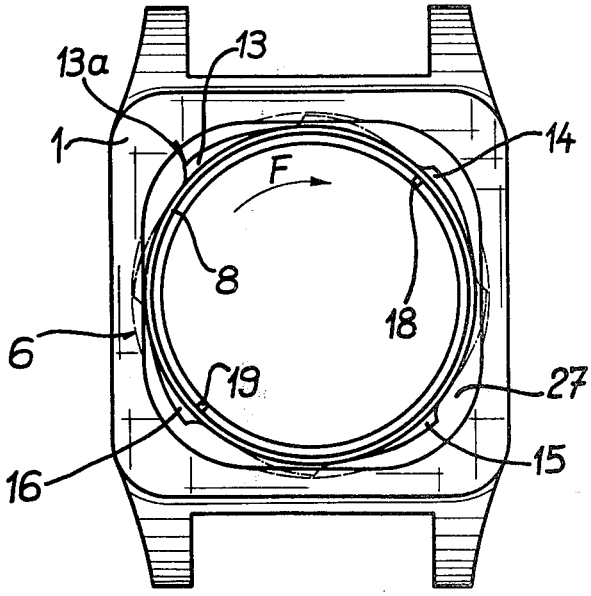
FIG. 2

SEALED, SHAPED WATCH-CASE

FIELD OF INVENTION

This invention relates to a sealed, shaped watchcase whereof the rim comprises a lower opening of approximately rectangular shape and in which a retaining ring is held axially by a part of the case.

BACKGROUND OF THE INVENTION

A watch-case of this type is known, in which the metal retaining ring bears directly on the base secured by a bayonet-fitting in a groove provided in the inner wall of the rim. When the base is removed in order to inspect the movement, to adjust or change the battery of an electronic movement, the retaining ring and consequently the movement are no longer retained and there is a risk of them becoming detached from the case. Moreover, all the vertical dimensions of the retaining ring and bayonet mounting have to be respected very strictly in order to facilitate an assembly without play, which requires high precision machining, which is relatively expensive.

SUMMARY OF THE INVENTION

The purpose underlying the invention is to provide a watch case capable of being constructed so as to facilitate removal of the base without releasing the mounting of the retaining ring and consequently of the movement, and also make it possible to increase the tolerances of vertical dimensions of components of the case.

According to the invention there is provided a sealed, shaped watch-case comprising a rim, said rim having a lower opening of approximately rectangular shape, and an elastically compressible retaining ring held axially in the rim by an annular part of circular shape having at least two projections which bear whilst the annular part compresses the retaining ring, on at least one bearing surface provided in the inner prismatic wall of the rim when said annular part is in a first angular position relative to the rim, said projections being able to engage freely axially in the shaped opening of the rim when the annular part is in a second angular position relative to the rim, and a base of the watch-case being secured by a notch on said circular annular part.

BRIEF DESCRIPTION OF DRAWINGS

The invention will now be further described, by way of example, with reference to the accompanying drawings in which:

FIG. 1 is an axial half-sectional view along the 3 o'clock–9 o'clock axis of a watch-case formed according to the invention and, FIG. 2 is a plan view on a reduced scale from below of the watch-case in FIG. 1 with the base absent.

DESCRIPTION OF PREFERRED EMBODIMENT

The shaped case illustrated in the drawings comprises a rim 1 in which a glass 2 is fixed by means of a sealing ring 3. Below a part 4, forming a shoulder, the rim 1 comprises a prismatic wall 5 extending to the lower end of the rim. Provided in this prismatic wall 5 is an annular groove 6 of rectangular cross-section, whose lower horizontal wall 7 serves as a bearing surface for a circular annular part 8 serving on the one hand to secure a retaining ring 9 intended to support a movement 10 surmounted by a face 11 and on the other hand to secure a base 12.

The securing part 8 is in the form of a circular ring able to be obtained by a cutting operation and provided with four projections 13, 14, 15 and 16 distributed uniformly on its circumference. Each of these projections is in the form of an oblique ramp with respect to the radius of the ring 8. At the height of the projection 16, the ring 8 comprises a notch 17 for the passage of a control shaft. Furthermore, two radially opposed notches 18 and 19 make it possible to rotate the ring 8 by means of a tool.

The retaining ring 9 is made from elastically compressible material, for example synthetic material. Its upper edges are provided with slits 20 which increase the elasticity thereof.

The base 12 is constituted by a shaped cup 22 in which a frame 23 is welded, comprising a frustoconical circular aperture 24 through which the frame 23 is secured by means of a notch on a bearing surface of interacting shape of the ring 8. Formed between the edge of the cup 22 and the raised edge of the frame 23 is an annular housing 25 in which a sealing ring 26 is located.

In the position shown in full line in FIG. 2, the ring 8 is in a position such that its projections 13 to 16 are located opposite the rounded corners of the approximately rectangular opening 27 of the rim, such that it is possible to introduce the ring 8 freely axially into the opening 27 in order to position the latter. For this purpose, a certain pressure is exerted on the ring 8 in order to compress the retaining ring 9 slightly, by rotating the ring 8 in the direction of arrow F until the projections 13 to 16 are engaged in the groove 6, i.e. on the bearing surface 7. From this instant, it is possible to release the pressure on the ring 8 and to continue to rotate the latter through an angle of approximately 45° until the upper end of the ramps of the projections, such as the end 13*a*, abuts against the base of the groove 6, by positioning the notch 17 in an annular manner for the passage of the shaft. This position of the ring 8 is illustrated in dot-dash lines in FIG. 2. When the ring 8 is secured, it is possible to attach the base 12, by simple pressure, to the ring 8. It will thus be ascertained that if the base is removed, the retaining ring 9 and with it the movement remain perfectly secured.

Since the ring 8 is put in position by elastic deformation of the retaining ring 9, the manufacturing tolerances of the ring 8 may be relatively wide. The same is true for the attachment of the base.

The invention is not limited to the embodiment illustrated. In particular, the projections of the ring 8 could have another shape. However, there must be at least two of the latter in order to ensure the attachment of the ring. As regards the base, it could be in one piece, round or of another shape.

What is claimed is:

1. A sealed non-circular watch-case comprising a rim having a rearward opening of generally rectangular shape, an inwardly projecting portion forming a shoulder spaced from the front of said rim and an inwardly opening groove rearwardly of said shoulder, a watch glass supported on said shoulder and sealed to said rim, a movement in said case, an elastically compressible retaining ring seated on the rear of said shoulder and retaining said movement, a circular securing ring having at least two opposite projections which in a first rotary position of said securing ring are insertable in opposite corner portions of said generally rectangular opening of said rim and upon rotation of said securing ring to a second rotary position are engageable in said groove of said rim to secure said securing ring in said rim, said securing ring bearing on said retaining ring to compress said retaining ring axially and secure said retaining ring and movement in said case, and a base of said watch-case having portions interengaging cooperating portions of said securing ring to secure said base to said rim.

2. A watch-case according to claim 1, in which said securing ring has a recess for the passage of a control shaft of said movement and means for positioning said securing ring in said second rotary position to ensure proper positioning of said recess for passage of said control shaft.

3. A watch-case according to claim 1, in which said projections comprise inclined ramps.

4. A watch-case according to claim 1 or claim 3, in which there are four of said projections on said securing ring, said projections being spaced equally angularly of said securing ring.

5. A watch-case according to claim 1, in which said base is cup-shaped and in which a frame welded in said base and defining a circular aperture has an interference push fit with an externally notched portion of said securing ring.

6. A watch-case according to claim 5, in which a sealing ring is fitted in a groove formed between said frame and the edge of said cup-shaped base.

* * * * *